US006138475A

United States Patent [19]

Kohl et al.

[11] Patent Number: 6,138,475

[45] **Date of Patent: *Oct. 31, 2000**

[54] JEWELRY RETENTION SYSTEM

[76] Inventors: Thomas D. Kohl, 13895 Braun Rd., Golden, Colo. 80401; Kenneth L. Mino, 3770 Allison Ct., Wheat Ridge, Colo. 80033

[ * ] Notice: This patent is subject to a terminal disclaimer.

[21] Appl. No.: 09/100,211

[22] Filed: Jun. 19, 1998

Related U.S. Application Data

[63] Continuation-in-part of application No. 09/045,281, Mar. 20, 1998.

[60] Provisional application No. 60/050,260, Jun. 19, 1997.

[51] Int. Cl.[7] ..... A44C 7/00

[52] U.S. Cl. ..... 63/12; 63/3.1; 24/705; 24/707.4

[58] Field of Search ..... 63/3.1, 12; 24/705, 24/707.4

[56] References Cited

U.S. PATENT DOCUMENTS

| | | |
|---|---|---|
| 183,164 | 10/1876 | Hessels . |
| 402,071 | 4/1889 | Doran et al. . |
| 494,456 | 3/1893 | Blaeske . |
| 878,885 | 2/1908 | Knoop . |
| 1,061,076 | 5/1913 | Hilditch . |
| 1,152,892 | 9/1915 | Henry . |
| 1,193,111 | 8/1916 | Breidenbach . |
| 2,653,367 | 9/1953 | Orchoff . |
| 2,667,675 | 2/1954 | Brutti . |
| 3,040,406 | 6/1962 | Artzt . |
| 3,402,438 | 9/1968 | Battistello . |
| 4,667,378 | 5/1987 | Sturm . |

FOREIGN PATENT DOCUMENTS

| | | |
|---|---|---|
| 3009607 | 9/1981 | Germany . |

*Primary Examiner*—Terry Lee Melius
*Assistant Examiner*—Andrea Chop
*Attorney, Agent, or Firm*—Holland & Hart LLP

[57] ABSTRACT

An apparatus and system for securing jewelry to a person's body, or to secure together the ends of a piece of jewelry. In one embodiment, an earring back for receiving a post of an earring has a base having a base aperture therein for receiving the post, and a first primary leg extending from a first end of the base, and a second primary leg extending from a second end of the base. A first spring leg extends from the first primary leg, the first spring leg having front face having a tear-drop shaped front aperture therein for receiving the post. A second spring leg extends from the second primary leg, the second spring leg having intermediate face having an intermediate aperture therein for receiving the post. The spring legs are biased such that when the earring back is uncompressed or not under external applied compressive forces, the front aperture, the intermediate aperture, and the base aperture are in axial misalignment. When the post is inserted through the apertures, the spring legs exert an outward force which secures the earring back about the post. Other embodiments include a clamping device and post for securing together the ends of jewelry such as bracelets, necklaces, or chokers.

18 Claims, 12 Drawing Sheets

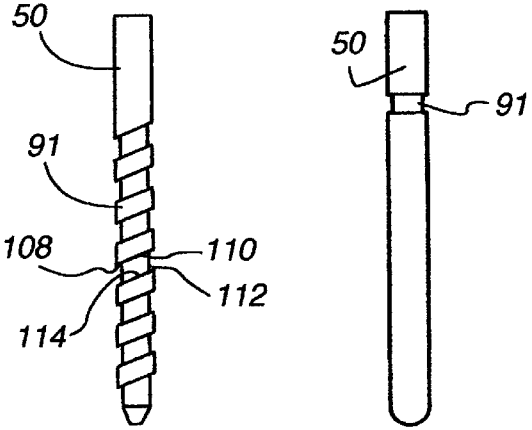
Fig. 12
Fig. 13
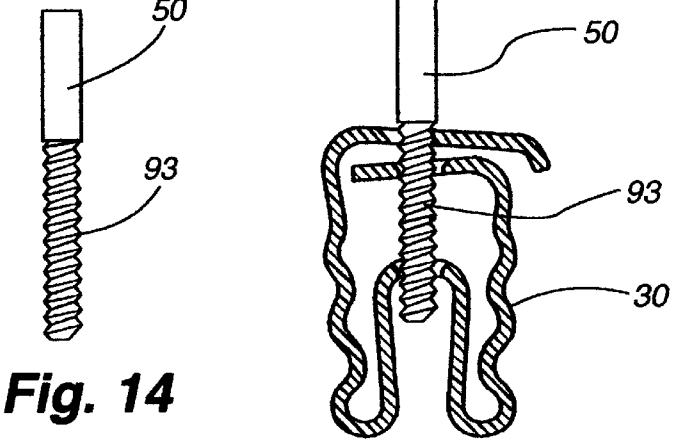
Fig. 14
Fig. 15
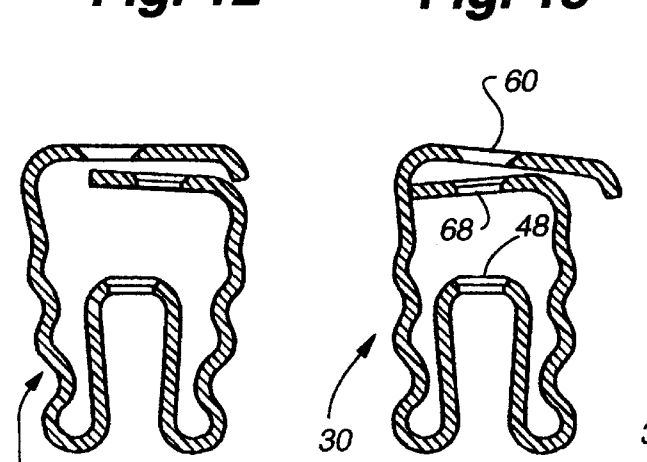
Fig. 16A
Fig. 16B
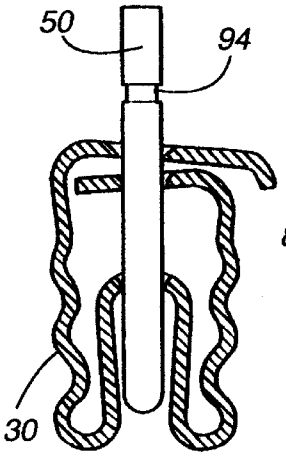
Fig. 16C
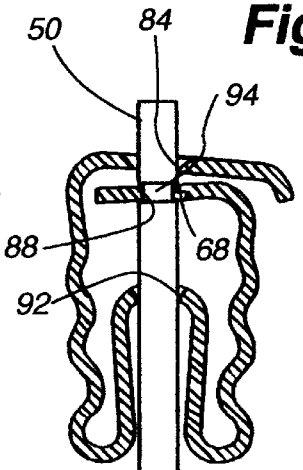
Fig. 16D
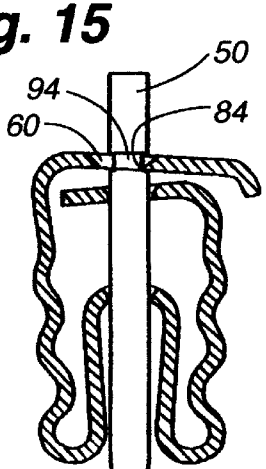
Fig. 16E

JEWELRY RETENTION SYSTEM

This application claims the benefit of, under 35 U.S.C. § 119(e), U.S. Provisional Patent Application Serial No. 60/050,260, filed Jun. 19, 1997, entitled MODIFIED EARRING RETENTION SYSTEM, which is expressly incorporated by reference herein in its entirety. This application is also a Continuation-in-Part of U.S. patent application Ser. No. 09/045,281, filed Mar. 20, 1998, which is expressly incorporated by reference herein in its entirety.

FIELD OF THE INVENTION

This invention relates in general to devices and methods for securing jewelry, and in particular to earring posts, earring backs, and attachment devices for bracelets or necklaces.

BACKGROUND

Pierced earrings typically have a post that is pushed through an aperture formed in a person's ear, or other body part. The earring is held in place by an earring back. Earring backs have a tendency to fall off the post as a result of normal use. For instance, screw-on earring backs unscrew due to the movement of the user, and are relatively expensive to replace when lost. They also require the post to be threaded. Most spring-loaded earring backs also work their way off of the earring post because they are not held on tightly enough due to their design.

Bracelets and necklaces conventionally utilize a solid first ring on one end of the bracelet or necklace, and on the other end a partial circular second ring which has a spring-loaded moveable arc portion which can be opened or closed by a tab. This system requires the wearer to align the opening of the second ring with the first ring while holding the tab in the open position. The first ring is then placed within the second ring through the open portion of the second ring, and the tab is released so that the rings are locked together. Locking the rings together can be particularly difficult when the wearer is attempting to secure the ends of a necklace behind the wearer's head, or attempting to secure a short bracelet about the wearer's wrist. Further, the spring-loaded moveable arc portion can rust and become non-functional.

Another conventional clasp mechanism includes a hinged box clasp on one end of the bracelet or necklace which is placed by the wearer about a slotted tongue portion on the other end of the bracelet or necklace. In order to couple the hinged box clasp to the slotted tongue portion, the wearer closes the box clasp about the slotted tongue portion, but if the wearer mistakenly fails to completely close the clasp, or if the clasp accidentally opens, the bracelet or necklace can subsequently become detached from the wearer.

Accordingly, with conventional jewelry retention devices, jewelry such as earrings, bracelets, necklaces can become accidentally detached from the wearer and the jewelry misplaced or lost, resulting in inconvenience or financial loss.

It is against this background that the various embodiments of the present invention were developed.

SUMMARY OF THE INVENTION

In light of the above, therefore, according to a broad aspect of the invention, an earring back for receiving a post of an earring is disclosed. The earring back has a base having a base aperture therein for receiving the post, and a first primary leg extending from a first end of the base, and a second primary leg extending from a second end of the base. A first spring leg extends from the first primary leg, the first spring leg having front face having a front tear-drop shaped aperture formed therein for receiving the post. A second spring leg extends from the second primary leg, the second spring leg having intermediate face having an intermediate aperture therein for receiving the post. The spring legs are biased such that when the earring back is uncompressed or not under external applied compressive forces, the front aperture, the intermediate aperture, and the base aperture are in axial misalignment. When the post is inserted through the apertures, the spring legs exert an outward force which secures the earring back on the post.

In one example, the base, the first primary leg, and second primary leg form a U-shaped member. The first spring leg can be L-shaped extending inwardly far enough to extend laterally over substantially all of the length of the base. The second spring leg is L-shaped extending inwardly far enough to extend laterally over substantially all of the length of the base. The first and second spring legs can have has at least one surface curve along a portion thereof. The first aperture can be substantially circular and the front face can have an indentation about the front aperture to assist the insertion of the post into the front aperture. The intermediate aperture can be tear drop shaped to as to provide self-alignment of the front, intermediate, and base apertures as the post is inserted in the earring back.

According to another broad aspect of the invention, a system is disclosed for securing a piece of jewelry, such as a bracelet, necklace, or choker, to a person's body. The system includes a post attached to the piece of jewelry, and a clamping device adapted to receive the post. The post has a surface treatment such as at least one circumferential notch adapted to couple with the front aperture of the clamping device. The circumferential notch can be angled along the axis of the post for ease of insertion of the post within the clamping device, while providing secure coupling between the post and the clamping device. The clamping device includes a base having a base aperture therein for receiving the post, and a first primary leg extending from a first end of the base, and a second primary leg extending from a second end of the base. A first spring leg extends from the first primary leg, the first spring leg having front face having a front aperture therein for receiving the post. A second spring leg extends from the second primary leg, the second spring leg having intermediate face having an intermediate aperture therein for receiving the post. The spring legs are biased such that when the clamping device is uncompressed or not under external applied compressive forces, the front aperture, the intermediate aperture, and the base aperture are in axial misalignment. When the post is inserted through the apertures, the spring legs exert an outward force which secures the earring back about the post.

According to another broad aspect of the invention, a system for securably attaching a first end of a piece of jewelry to a second end of the piece of jewelry is disclosed. The system includes a post attached to the first end of the piece of jewelry, and a clamping device adapted to receive the post, the clamping device coupled to the second end of the piece of jewelry. The clamping device includes a base having a base aperture therein for receiving the post, and a first primary leg extending from a first end of the base, and a second primary leg extending from a second end of the base. A first spring leg extends from the first primary leg, the first spring leg having front face having a front aperture therein for receiving the post. A second spring leg extends from the second primary leg, the second spring leg having intermediate face having an intermediate aperture therein for receiving the post. The spring legs are biased such that when the clamping device is uncompressed or not under external applied compressive forces, the front aperture, the intermediate aperture, and the base aperture are in axial misalignment. When the post is inserted through the apertures, the spring legs exert an outward force which secures the earring back about the post.

In one example, the clamping device is positioned within the second end of the jewelry, and the clamping device has an externally depressable tab along a portion of the intermediate spring leg. Alternatively, the clamping device has a set of aligned apertures passing through the front spring leg, the intermediate spring leg, the first primary leg, and the second primary leg, the aligned apertures adapted to receive a ring attached to the second end of the jewelry.

The foregoing and other features, utilities and advantages of the invention will be apparent from the following more particular description of a preferred embodiment of the invention as illustrated in the accompanying drawings and as defined by the appended claims.

BRIEF DESCRIPTION OF THE DRAWINGS

FIG. 12 illustrates a jewelry post having angled circumferential notches adapted to mate with a jewelry clamping device in accordance with one embodiment of the present invention.

FIG. 13 illustrates a jewelry post having a notch adapted to mate with a jewelry clamping device in accordance with one embodiment of the present invention.

FIG. 14 illustrates a threaded post adapted to mate with a jewelry clamping device in accordance with one embodiment of the present invention.

FIG. 15 illustrates a jewelry clamping device secured about the threaded post of FIG. 14 in accordance with one embodiment of the present invention.

FIGS. 16A–E illustrate the process of securing a jewelry clamping device about a jewelry post in accordance with one embodiment of the present invention.

DETAILED DESCRIPTION OF THE PREFERRED EMBODIMENTS

Figure 1:
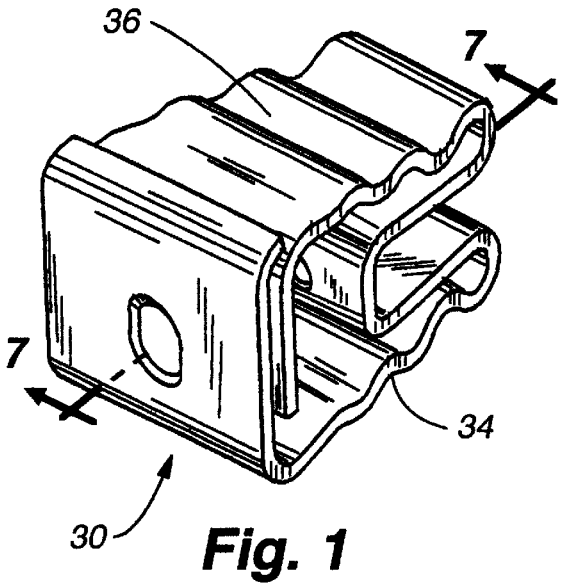
FIG. 1 is an isometric view of a jewelry clamping device in accordance with one embodiment of the present invention.
Figure 2:
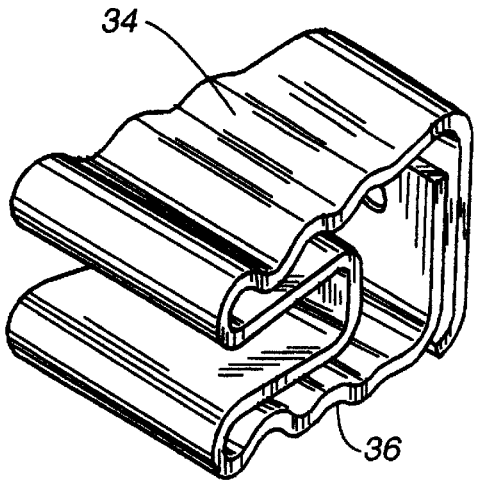
FIG. 2 illustrates an isometric view of the jewelry clamping device of FIG. 1.
Figure 3:
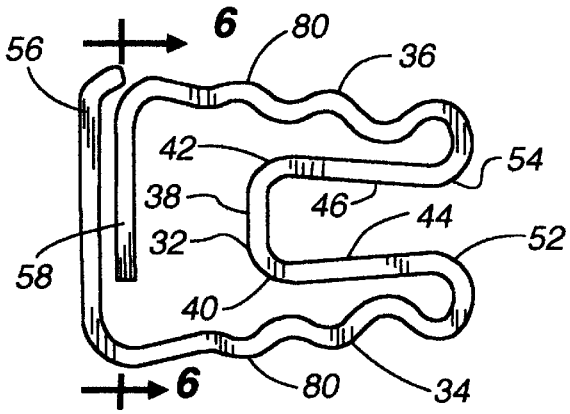
FIG. 3 illustrates a side view of the jewelry clamping device of FIG. 1 wherein the section line 6—6 is shown passing through the intermediate aperture of the immediate spring leg.
Figure 4:
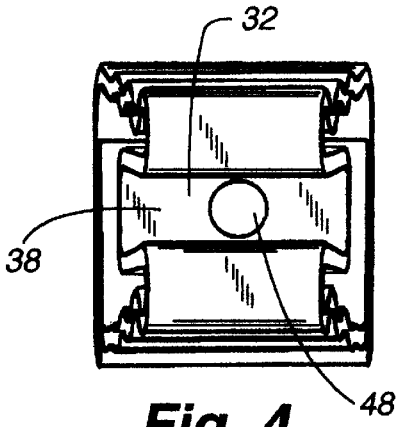
FIG. 4 illustrates an end view of the jewelry clamping device of FIG. 1.
Figure 5:
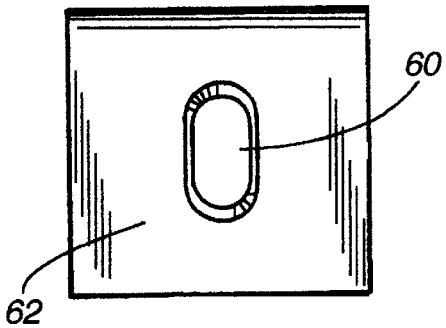
FIG. 5 illustrates an end view of the jewelry clamping device of FIG. 1 showing the front aperture of the front spring leg in accordance with one embodiment of the present invention.

An earring retention system is shown in FIGS. 1–20, and includes both the earring back and the associated post. A spring-action earring back is disclosed that tightly clamps the post of the earring and virtually eliminates the problem of unwanted disconnection from the post. The earring back can be used on threaded posts, smooth posts, or on the slotted post as disclosed below. As used herein, the term jewelry "clamping device" refers to the various embodiments of the earring back as used with earrings or other jewelry such as bracelets and necklaces, as shown and described herein. The term jewelry "post" refers to the various embodiments of the posts as used with earrings or other jewelry as shown and described herein. Accordingly, the terms "earring back", "jewelry clamping device", and "clamping device" are used interchangeably, and the terms "earring post", "jewelry post", and "post" are also used interchangeably.

Referring to FIGS. 1–9, the earring back 30 includes a U-shaped main body 32 and two depending spring legs 34, 36, the legs being biasingly attached to the main body. The main body defines a base 38 having opposing ends 40, 42 with a primary leg 44, 46 attached to each opposing end and extending substantially perpendicularly from the base. The base defines an aperture 48 formed therethrough to receive the post 50, as is described below.

The distal ends 52, 54 of the primary leg are each attached to, preferably integrally, the proximate end of one spring leg 34, 36 respectively. Each spring leg 34, 36 bends back over and extends along the length of the primary leg to which it is attached, extends beyond the base member 38 of the main body, and terminates in an L-shape 56, 58, with the L-shape 56, 58 extending inwardly at least far enough to extend laterally the entire length of the base 38 of the main body. One spring leg 34 is the "front" leg, the other spring leg 36 is the "intermediate" leg. The L-shaped portions 56, 58 of each of the spring legs overlap each other.

Each L-shaped portion defines an aperture. The front leg 34 defines a front aperture 60, preferably oval or oblong in shape, in the L-shaped portion 56. The front aperture 60 is positioned, preferably, on a front face 62 less than half way from the bend 64 forming the L-shape and the free end 66. The free end 66 of the front leg 34 is bent rearwardly to a small extent. The intermediate leg 36 defines an intermediate aperture 68 on an intermediate face 70 approximately half-way between the bend 72 forming the L-shape and the free end 74. Each of the apertures 48, 60 and 68 forms a rim that partially engages the outer surface of the post 50.

Figure 7:
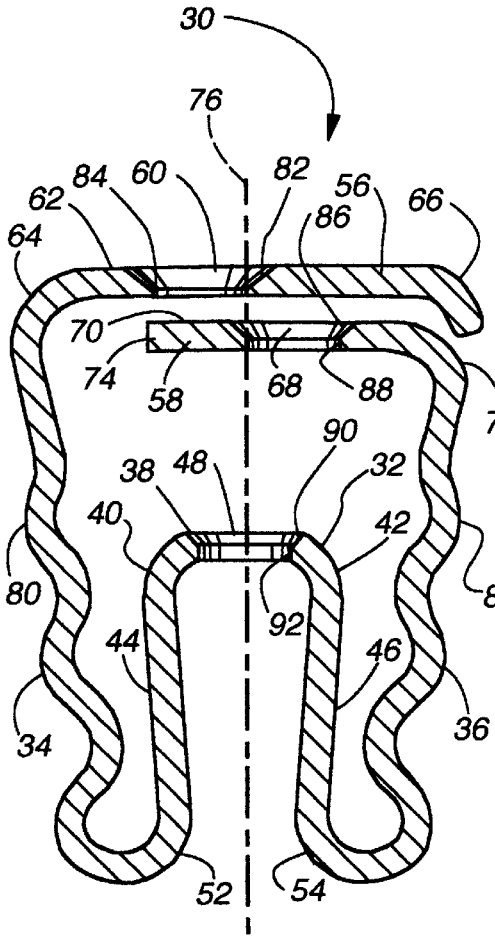
FIG. 7 illustrates a sectional view of the jewelry clamping device of FIG. 1 along section lines 7—7 wherein the jewelry clamping device is in a free or uncompressed position.

In the free, uncompressed position (no external forces applied to the earring back), the three apertures 48, 60 and 68 are axially mis-aligned (see FIGS. 7, 9, 10) in a plane 76 extending perpendicularly through the earring back as shown in FIG. 7. The apertures are vertically aligned in the plane of FIG. 7 so that the apertures are each offset a substantially equal distance 77 from the edge 78 of the earring back as seen in FIG. 10. In the misaligned orientation, the front aperture 60 (due to the position of the front leg 34) is shy of being axially aligned with the base aperture 48, and the intermediate aperture 68 (due to the position of the intermediate leg 36) is shy of being axially aligned with the base aperture 48. In the preferred embodiment, the misalignment is such that the front and intermediate legs must be pushed towards one another to axially align the front, intermediate and base apertures (see FIG. 16B), as is described in further detail below.

The spring bias maintaining the front and intermediate legs in the preferred position is created in the bend 40, 42 between the base member 38 of the main body and the primary legs 44, 46, and in the bend 52 at the connection of the front leg 34 with the primary leg 44, and the bend 54 at the connection of the intermediate leg 36 with the other primary leg 46. When the front and intermediate legs 34, 36 are pushed towards one another, the earring back resiliently bends at these locations to allow alignment of the apertures, and when the earring back is released, the bias force created at these locations tends to return the front and intermediate legs to the free position (FIG. 7) by biasing them outwardly.

Each of the front and intermediate legs 34, 36 has a series of curves 80 along their respective lengths. The curves 80 form a gripping surface for easy grasping by the user. The curves could be replaced by bumps or another gripping surface, depending on the technique used to manufacture the inventive earring back.

The apertures 48, 60, 68 can all have straight side walls, or can have different profiles as desired for enhanced performance. For instance, the front aperture 60 can have a chamfered or countersunk shape 82 through substantially its entire depth. A small straight-sided portion 84 of the aperture remains at the rearward surface of the L-shaped portion 56. This aperture profile forms a sharp edge for assisting in gripping the post 50, as described below. The intermediate aperture 68 can also have a countersunk or chamfered profile 86, and preferably has a larger amount 88 with straight side walls. The base aperture 48 can also have a countersunk profile 90 with approximately one-half of its depth 92 defining a straight side wall.

Figure 10:
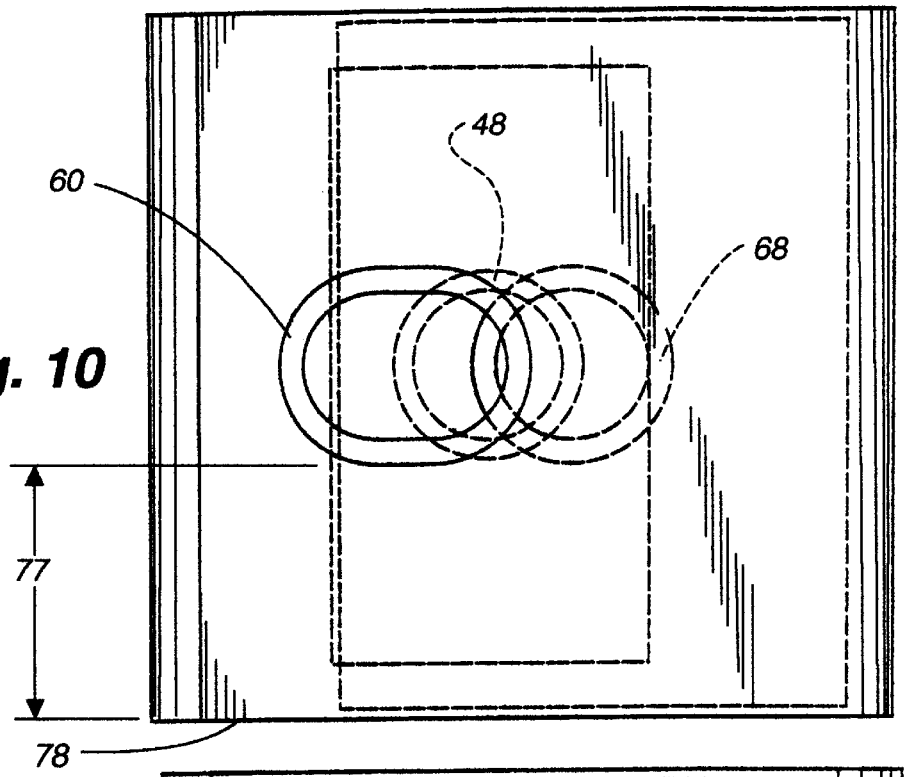
FIG. 10 illustrates a front-end view of the jewelry clamping device shown in FIG. 1 illustrating the alignment of the apertures when the clamping device is in a free or uncompressed position.
Figure 11:
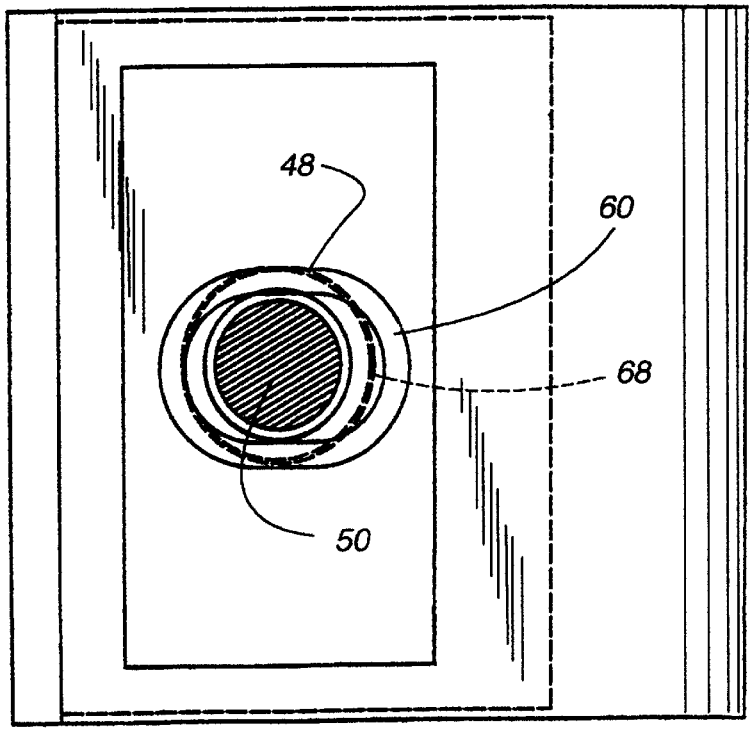
FIG. 11 illustrates a front-end sectional view of the jewelry clamping device secured about an earring post along section lines 11—11 of FIG. 8.

FIG. 10 shows a front view of the apertures 48, 60, 68 in the free position, where they are axially mis-aligned. FIG. 11 shows a front view of the apertures 48, 60, 68 after they have been aligned, a post 50 has been inserted, and the earring back released.

The posts used with this earring back can be smooth walled (FIG. 8), notched (or have some other surface treatment 91) (FIGS. 12 and 13), or threaded 93 (FIGS. 14, 15). The notched wall is preferred, and assist in creating a strong retention force of the earring back on the post. The sidewalls of the individual notches can be sloped (FIG. 20) or at a right angle to the base of the notch (FIGS. 12, 13). The sloped profile allows the earring back to be applied more easily. The profiled apertures more easily engage the surface features (threads, notches) than an non-profiled aperture, and are also believed to engage a smooth post with more force per unit area (smaller engagement area, which is the rim of the aperture that touches the post) to create an enhanced engagement force.

Figure 8:
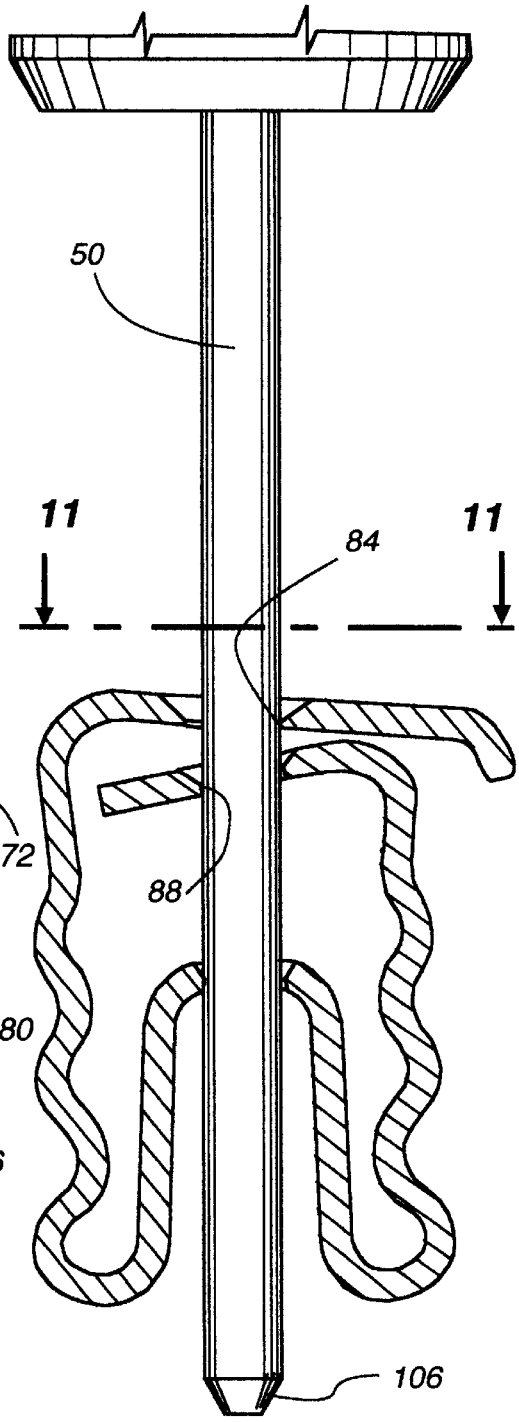
FIG. 8 illustrates a representational sectional view of the jewelry clamping device of FIG. 1 wherein the jewelry clamping device is secured about a jewelry post, in accordance with one embodiment of the present invention.

In use, in general, the user grasps the earring back 30 and compresses the front and intermediate spring legs 34, 36 to axially align the front, intermediate and base apertures 60, 68, 48. When the apertures are aligned, the post 50 is inserted through the apertures. When the post has been inserted through the aligned apertures, the user releases the front and intermediate legs, which then spring back under the bias force, causing the rims 84, 88 of the front and intermediate apertures to engage the walls of the post 50, to hold the post in position with respect the earring back. The base aperture 48 assists by holding the post in the roughly proper position. FIG. 8 shows the earring back positioned about an earring post.

As shown in FIGS. 16D and 16E, the post 50 can have a specifically positioned notch 94 formed at the proper position to be engaged by either the rim 84 of the front aperture (FIG. 16E) or by the rim 88 of the intermediate aperture (FIG. 16D). The engagement of the rim of the aperture (front or intermediate) in the specifically located notch assists in providing a secure, snap-in fit.

FIGS. 16A–16E show the sequence of using the earring back. FIG. 16A shows the earring back 30 in the free position. FIG. 16B shows the earring back 30 in the compressed, or squeezed, position to align the apertures 48, 60, 68. FIG. 16C shows the insertion of the post 50. FIG. 16D shows the release of the back 30 to allow the legs 34, 36 (front and intermediate) to spring back under bias force in an outwardly direction to cause the rims 84, 88, 92 of the apertures to engage the outer surface of the post 50 and securely grip the post. In FIG. 16D a single notch 94 is shown aligned with the intermediate aperture 68. In FIG. 16E, a single notch 94 is shown aligned with the front aperture 60.

The earring back of the present invention is advantageous because of the dual spring force applied to the post to retain the earring back on the post. In addition, if the post 50 is serrated, notched, threaded, or has some other surface treatment, the retention force is increased by increased friction or mechanical interference in addition to the clamping force created by the spring bias. The front aperture 60 is oval or oblong to assist the user in finding the aperture 60 with the post when the earring is in one's ear and is difficult to see.

Figure 6:
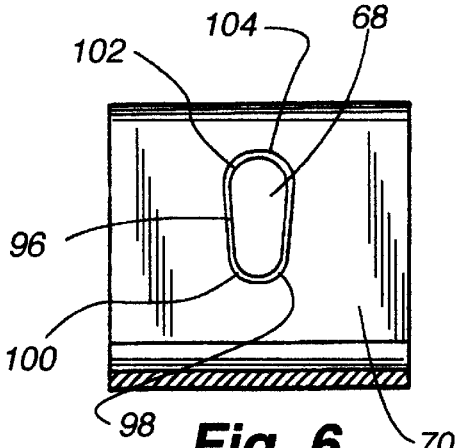
FIG. 6 illustrates a sectional view taken along section lines 6—6 of FIG. 3 showing the intermediate aperture of the intermediate spring leg in accordance with one embodiment of the present invention.

As previously discussed, the apertures of the earring back or clamping device can have different profiles. FIG. 6 shows a tear drop, tapered profile 96 used with the intermediate aperture 68 on the intermediate spring leg 36 in accordance with one embodiment of the present invention. The tapered profile 96 permits the post to be more easily inserted into the clamping device and reduces the amount of compression which the wearer has to externally apply to the legs. The tapered or tear drop profile 96 shown is formed by a smaller arc 90 having a smaller radius at one end 100 of the intermediate aperture, and a larger arc 102 at the other end 104 of the intermediate aperture, where the larger arc has a larger radius than the smaller arc.

As the tip 106 of the post 50 (FIG. 8) is inserted into the front aperture, the tip 106 of the post engages the smaller arc 98 (FIG. 6) of the intermediate aperture 68 due to the slight overlap between the front and intermediate apertures previously described. The smaller arc 98 of the intermediate aperture should have a radius slightly smaller than the radius of the post 50, and the smaller arc 98 should be oriented towards the center of the intermediate face 70 of the intermediate spring leg, so that the tip of the post initially engages the smaller arc 98 as the post engages walls of the intermediate aperture. As the post 50 is pushed through the intermediate aperture 68, the post exerts a tangential force on the smaller arc 98 of the intermediate aperture which tends to move the intermediate spring leg 36 inwardly towards the compressed position. As the post is inserted through the front and intermediate apertures, these apertures also align the post with the base aperture 48.

Figure 9:
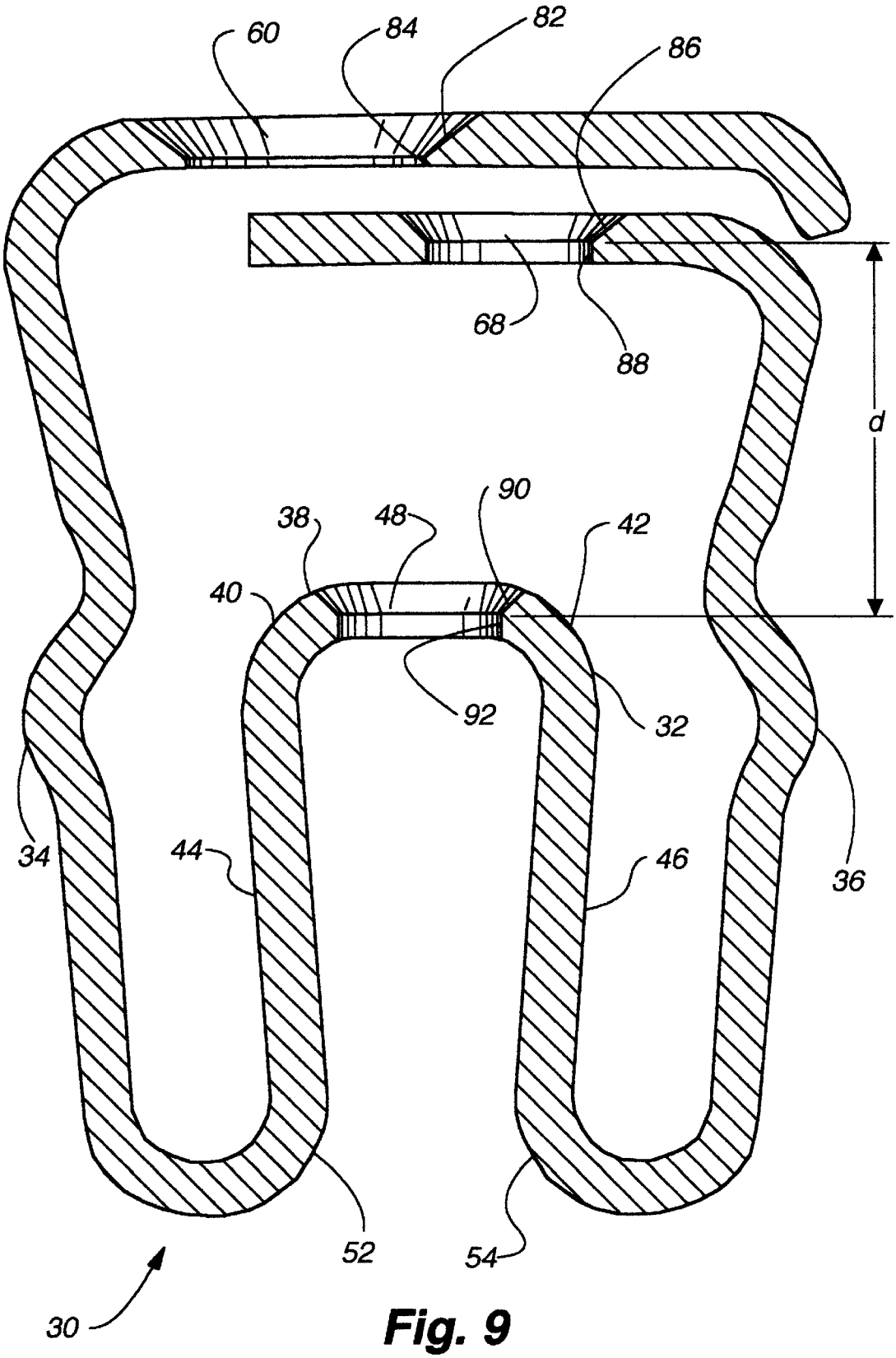
FIG. 9 illustrates a representational cross-sectional view of the jewelry clamping device in accordance with one embodiment of the present invention.

As shown in FIG. 9, a distance (d) is preferably 0.030 inches, but preferably no greater than 0.050 inches, between the intermediate aperture 68 and the base aperture 48 permits the post to be properly aligned with the base aperture 48 after passing through the intermediate aperture 68. This dimension can be used regardless of whether the intermediate aperture 68 has an oval or tear drop, tapered profile. When the tear drop, tapered profile is used with the intermediate aperture, a self-compression and self-alignment feature of the clamping device is provided to permit easier insertion of the post within the clamping device.

As previously discussed, the post can have different profiles and different surface treatments. FIG. 12 illustrates one embodiment of the post 50 wherein angled circumferential notches 91 are provided on the outer surface of the post. The angled notches 91 permit the post to be easily inserted in the clamping device as the clamping device is compressed, but also improve the prevention against the clamping device from being removed from the post. The angled notches 91 define an upper point 108 corresponding to the lower edge 110 of one notch, and a lower point 112 corresponding to the upper edge 114 of an adjacent notch. Each spring leg of the clamping device is then securely positioned between the upper point 108 and the lower point 112. Due to the spring forces exerted outwardly by the spring legs, the rims of apertures of the spring legs engage the upper or lower points of the angled notches which provides even greater resistance to accidental movement of the clamping device along the axis of the post.

As previously discussed, the surfaces of the legs can vary and the apertures can have different profiles. FIGS. 17–20 illustrate a clamping device 120 having oval or circular profile 122 on the front face 124 of the front spring leg 126, and smoothly inwardly curved surfaces 128, 130 along the front leg 132 and intermediate leg 134. The profile of the front face 124 can be shaped for different aesthetic appearances. The inwardly curved surfaces 128, 130 of the legs 132, 134 permit the clamping device to be easily grasped by the user.

An indentation 140 can be provided on outer surface of the front face 124 about the front aperture 142 to assist the insertion of the post within the front aperture. The indentation 140 can take various shapes, such as the circular shape shown in FIG. 17. This circular indentation 140 can be formed by impressing or stamping a ball-bearing tip onto the outer surface of the front face 124.

Figure 17:
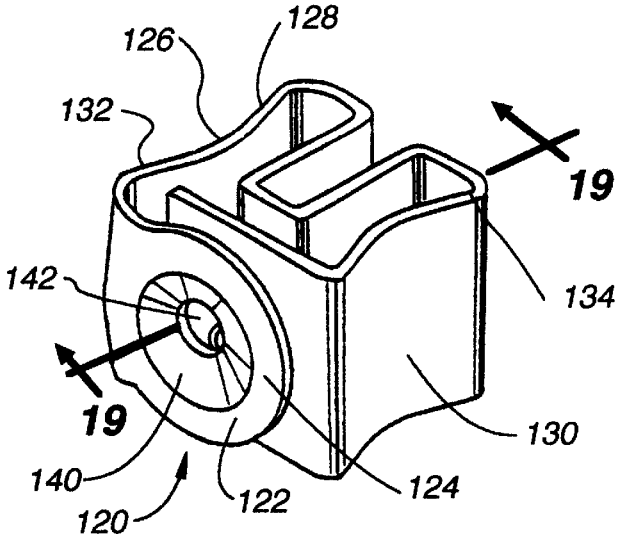
FIG. 17 is an isometric view of a jewelry clamping device in accordance with one embodiment of the present invention.
Figure 18:
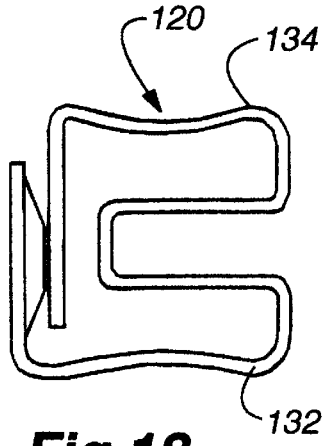
FIG. 18 is a top plan view of the jewelry clamping device of FIG. 17.
Figure 19:
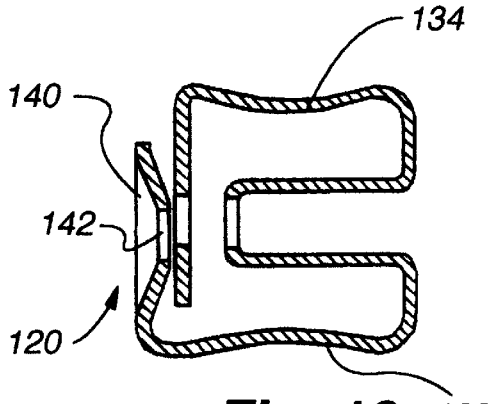
FIG. 19 is a sectional view of the jewelry clamping device of FIG. 16 along the 19—19 section lines.
Figure 20:
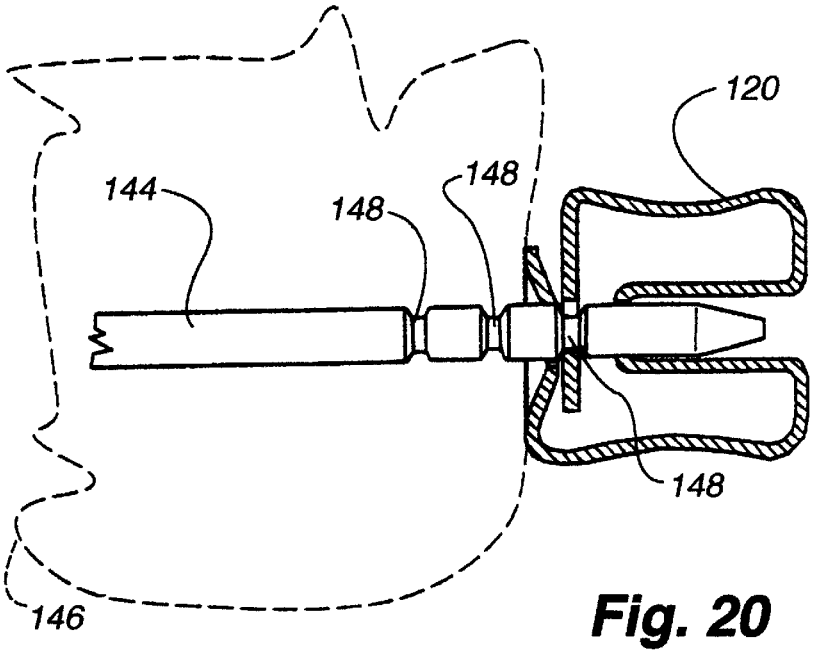
FIG. 20 illustrates the jewelry clamping device of FIG. 17 secured about a jewelry post adjacent an ear of a wearer.
Figure 22:
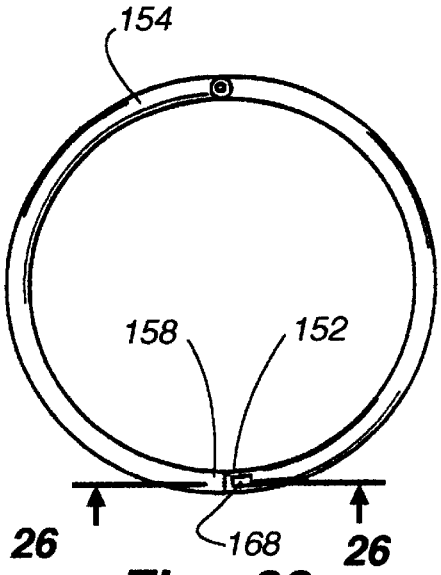
FIG. 22 illustrates the piece of jewelry of FIG. 21 wherein the ends thereof are secured together by the jewelry clamping device and the jewelry post.
Figure 21:
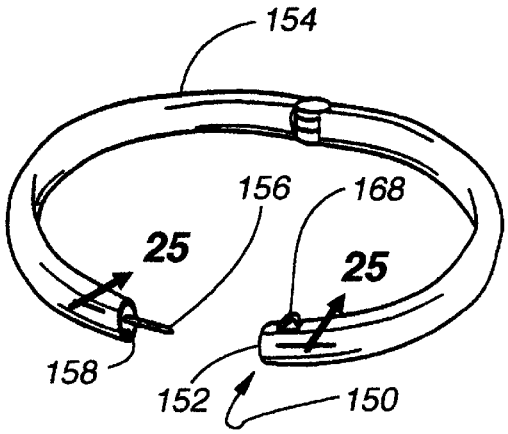
FIG. 21 illustrates a piece of jewelry wherein a jewelry clamping device and a jewelry post are positioned within the ends of the piece of jewelry for securement thereof about the wearer in accordance with one embodiment of the present invention, wherein the piece of jewelry is in the open position.
Figure 24:
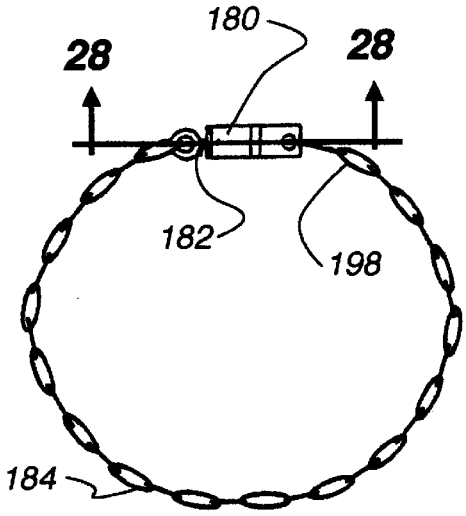
FIG. 24 illustrates the piece of jewelry of FIG. 23 wherein the ends thereof are secured together by the jewelry clamping device and the jewelry post.
Figure 23:
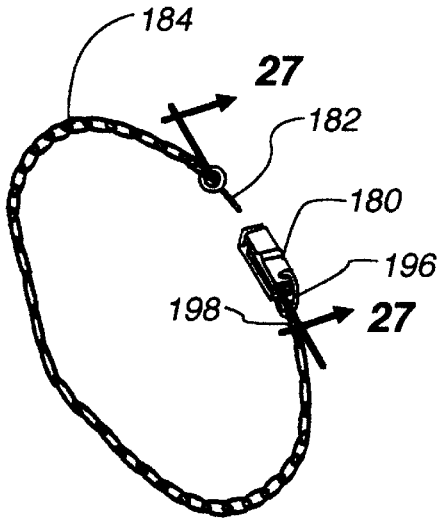
FIG. 23 illustrates a piece of jewelry wherein a jewelry post and a jewelry clamping device are attached to the ends of the piece of jewelry in accordance with one embodiment of the present invention.
Figure 26:
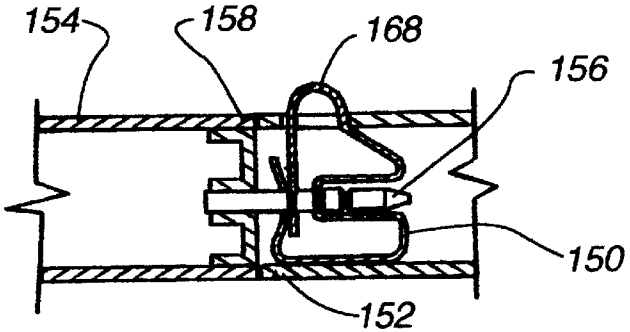
FIG. 26 is a sectional view along section lines 26—26 of FIG. 22 illustrating the jewelry clamping device secured about the jewelry post in accordance with one embodiment of the present invention.

FIG. 20 illustrates the clamping device 120 of FIG. 17 secured about a post 144 through an ear 146 of a wearer. The post 144 has a set of three circumferential notches 148 which are provided so that the clamping device can be secured about ears of varying thickness or at different levels of tightness. Depending on the wearer's preference, the clamping device can be secured about the any of the notches 148 or a combination thereof. The spacing between the notches 148 can be selected to correspond to the distances between the apertures of the clamping device 120.

Figure 25:
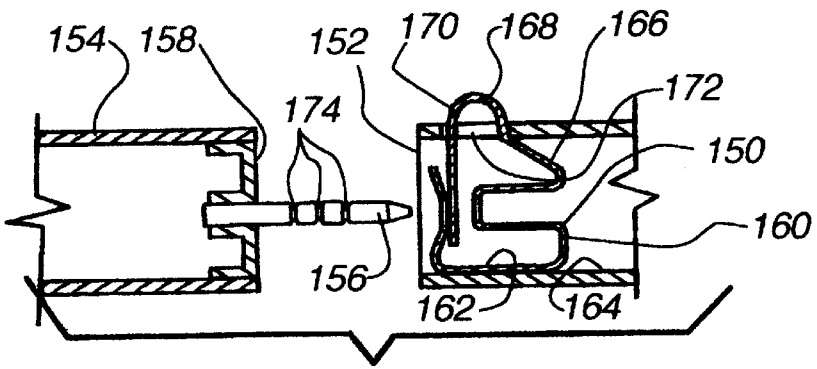
FIG. 25 is a sectional view along section lines 25—25 of FIG. 21 illustrating the jewelry post and the jewelry clamping device in accordance with one embodiment of the present invention.
Figure 28:
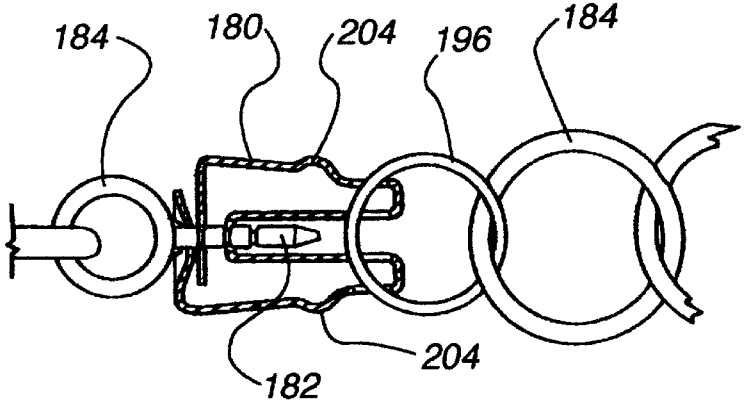
FIG. 28 is a sectional view along section lines 28—28 of FIG. 24 illustrating the jewelry clamping device secured about the jewelry post in accordance with one embodiment of the present invention.

In another embodiment of the present invention, the clamping device and post can be used to secure together the ends of jewelry, such as bracelets, necklaces, chokers, etc., as shown in FIGS. 21–28. Referring to FIGS. 21, 22, 25 and 26, a clamping device 150 is secured within one end 152 of a piece of jewelry 154, and a post 156 is secured within the other end 158 of the piece of jewelry 154 so that the two ends of the jewelry can be secured together using the clamping device and post 156. As shown in FIG. 25, the front spring leg 160 has a flat side 162 which abuts the interior surface 164 of the jewelry. The intermediate spring leg 166 has a depressable tab 168 formed about the bend 170 of the leg which is externally depressable through a slot 172 in the jewelry. The tab 168 can be depressed to assist with the insertion of the post 156 within the clamping device 150, or a tear drop shaped tapered intermediate aperture can be used to provide for self-alignment as discussed above. Once the ends 152, 158 of the jewelry 154 are secured together within the clamping device, the tab 168 can be depressed to permit the removal of the post from the clamping device, thereby releasing the ends of the jewelry. The post 156 can be provided with a set of notches 174 spaced to mate with the apertures of the clamping device.

Figure 27:
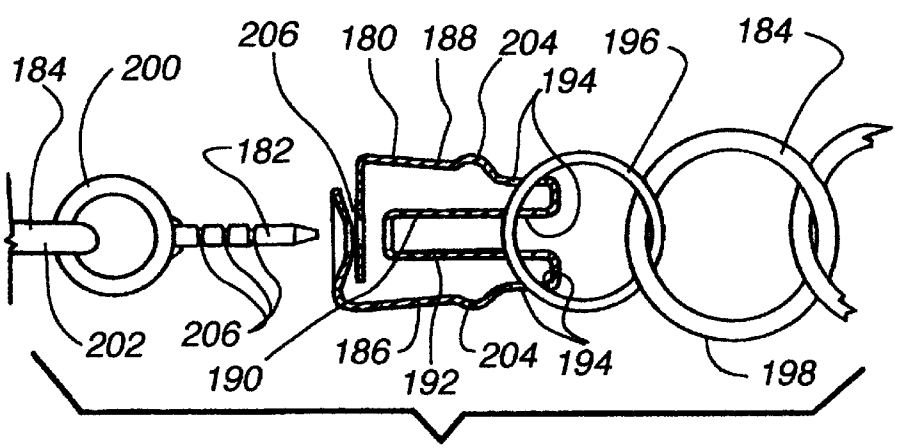
FIG. 27 is a sectional view along section lines 27—27 of FIG. 23 illustrating a jewelry post and a jewelry clamping device in accordance with one embodiment of the present invention.

FIGS. 23, 24, 27, and 28 show another embodiment of the present invention wherein the clamping device 180 and post 182 are used to secure the ends of a piece of jewelry 184 having ring ends. Referring to FIG. 27, the front spring leg 186, the intermediate spring leg 188, and each primary leg 190, 192 each have aligned apertures 194 formed therethrough which receive a first ring or loop 196 coupled to a first end 198 of the jewelry. The post 182 is secured to a second ring 200 which is coupled to the second end 202 of the jewelry 184. It is understood that while rings or loops are used to couple the clamping device and post to the ends of the jewelry, other structures could be equivalently utilized.

The front spring leg 186 and intermediate spring leg 188 are also provided with depressable tabs 204 formed along the side walls. The tabs 204 can be depressed to assist with the insertion of the post within the clamping device, or a tear drop shaped tapered intermediate aperture 206 can be used to provide for self-alignment as discussed above. Once the ends 198, 202 of the jewelry are secured together within the clamping device, the tabs 204 can be depressed to permit the removal of the post from the clamping device, thereby releasing the ends of the jewelry. The post 182 can be provided with a set of notches 206 spaced to mate with the apertures of the clamping device.

Accordingly, as shown and described above, the clamping device and post of the present invention can be used to secure jewelry, such as earrings, to a person's body, or to secure together the ends of jewelry such as bracelets, necklaces, chokers, etc. It is understood that the clamping device and post shown and described above can be used in other applications to secure two articles together. For instance, the clamping device and post can be used as an electrical connector electrically coupling at least two conductors together. A first conductor can be coupled, for example by solder or other means, to the clamping device, while a second conductor can be coupled, for example by solder or other means, to a post having notches or a slotted profile as discussed above. The clamping device and post can be made of electrically conductive material so that the two conductors are electrically coupled when the post is secured within the clamping device. In such an application, the clamping device and post of the present invention would permit a secure electrical connection between two conductors where the connection could be de-coupled as needed. The clamping device and post could be included within a wire harness or casing to provide electrical isolation from other conductors.

Figure 29:
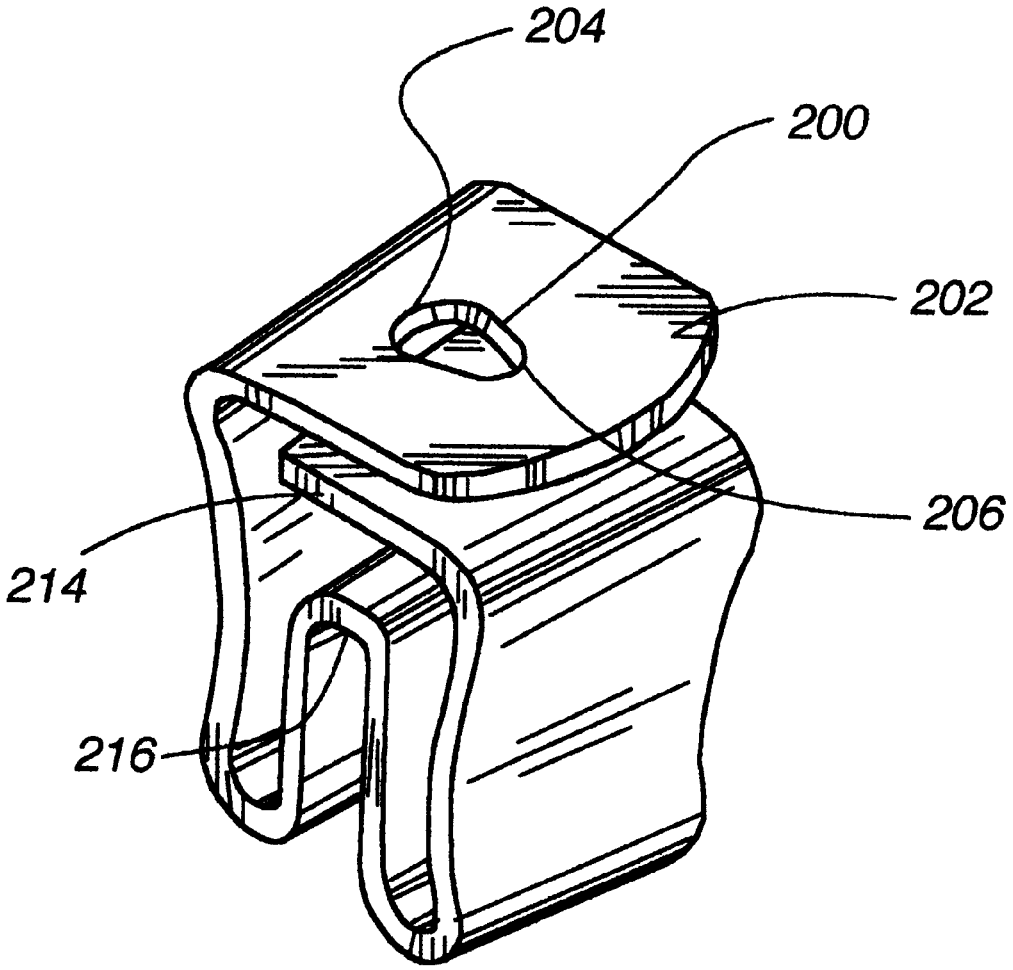
FIG. 29 is a perspective view of an alternative embodiment of the earring back, showing a front aperture being tear-dropped shaped.
Figure 30:
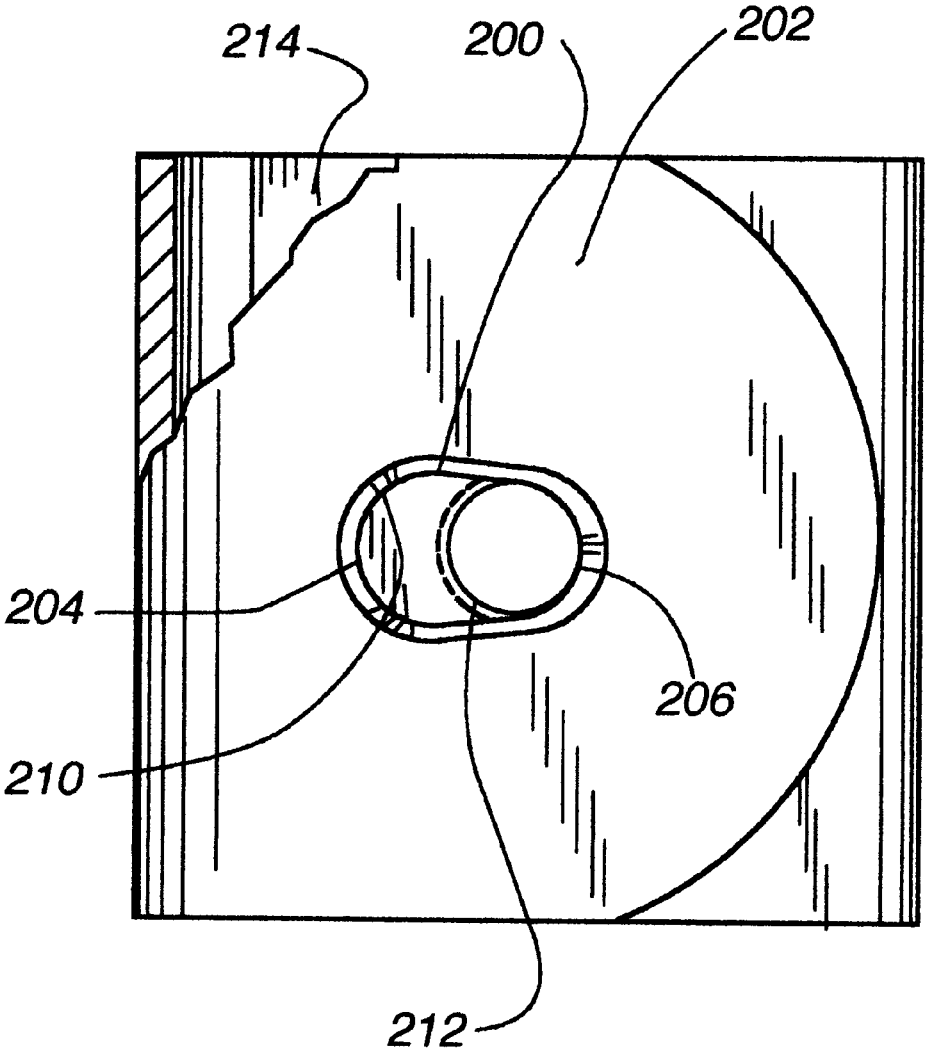
FIG. 30 is a top view of the earring back shown in FIG. 29.

FIGS. 29 and 30 show an alternative embodiment of the apertures formed in the legs, specifically that the aperture 200 in the front leg 202 (first aperture) has an elongated tapered or wedge-shape with a rounded wide end 204 and a rounded narrow end 206. The basic structure of this embodiment of the earring back is the rounded wide end 204 is located toward the bend of the L-shape, and the rounded narrow end 206 is located toward the free end of the L-shape. The perimeter 210 of the first aperture 200 is beveled or countersunk (similar to that shown in FIG. 9), forming an apex at approximately its center point. The apex can be pointed or rounded. The dimensions of the narrow end of the tapered hole are designed to "wrap around" the post and contact approximately one-third to one-half of the circumference of the post.

The aperture 212 in the intermediate leg 214 (second aperture) is circular. The perimeter of the second aperture 212 is beveled or countersunk also (similar to that shown in FIG. 9), forming an apex at approximately its center point. The apex can be pointed or rounded.

The aperture in the base 216 (third aperture) is circular. The perimeter of the third aperture is beveled or countersunk also (similar to that shown in FIG. 9), forming an apex at approximately its center point. The apex can be pointed or rounded.

As mentioned above, the first aperture 200 is tapered, the second aperture 212 is circular, and the third aperture is circular. Alternatively, the first aperture can be circular, the second aperture can be tapered, and the third aperture can be circular. Where the second aperture is tapered, the rounded wide end is located toward the bend of the L-shape, and the rounded narrow end is located toward the free end of the L-shape, for purposes described below. Any combination of aperture shapes (including first and second apertures being tapered) is contemplated.

Figure 31:
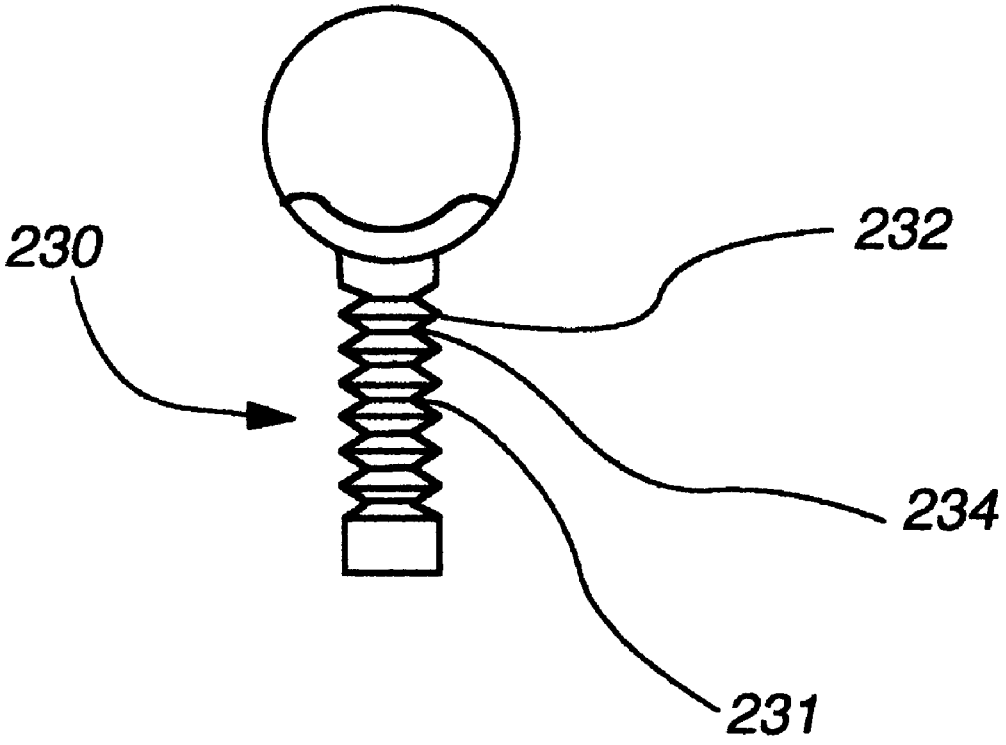
FIG. 31 shows a post having continuous grooves along its length.
Figure 33:
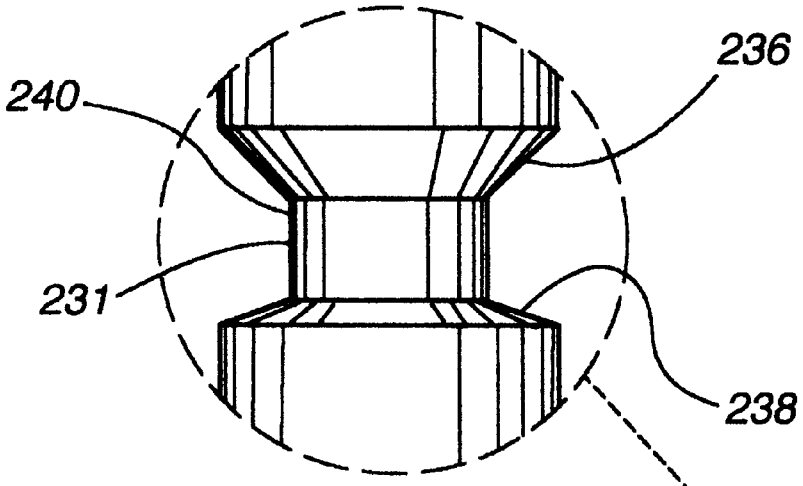
FIG. 33 is an enlarged view of one of the grooves of FIG. 32, and shows the front and rear edges of the grooves angled to approximately 45 degrees from the post.
Figure 32:
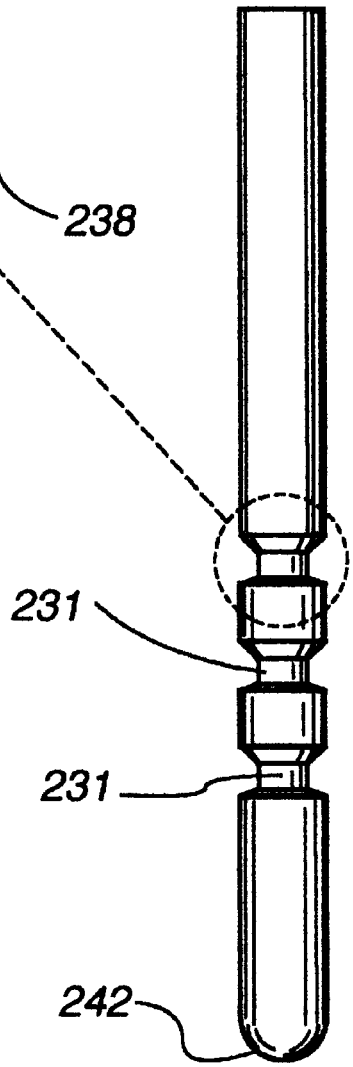
FIG. 32 is a post, and shows annular grooves spaced longitudinally along the length of the post.

Alternative embodiments of the post 230 for use with earring back of the present invention are shown in FIGS. 31–33. The post can be smooth, threaded, slotted or somehow roughened to improve the gripping force of the earring back on the post. The post can have annular grooves 231 with rounded or pointed peaks 232 and valleys 234 (FIG. 31). Rounded peaks and valleys allows easier insertion and extraction of the post from the earring back. The annular grooves forming the peaks and valleys can be separated along the length of the post (FIG. 32) or continuous (FIG. 30).

A preferred post is shown in FIGS. 32 and 33. The grooves 231 are separated longitudinally along the length of the post (no decorative portion of the post is shown). Each groove has a front wall 236 (towards the top end in FIG. 33) and a rear wall 238 (near the bottom end in FIG. 33). The front wall 236 is more sloped than the steeper rear wall 238. The groove 231 can have a flat, curved, or pointed bottom 240. The bottom end 242 of the post can be flat, rounded or pointed.

When a grooved or threaded post is used, the edges (such as 210) or apexes of the circumferences of the first, second and/or third apertures seat in and engage one of the valleys formed in the post to enhance the gripping force of the earring back on the post. While all three preferably seat in a valley, if only one or two of the apertures edges seat in a valley, sufficient retention of the post in the earring back is established. Where used with a threaded post, the earring back can be pushed on and screwed (unthreaded) off if desired.

The groove (or circumferential notch) design in FIGS. 31 and 32 facilitate the "push-on" feature of the earring back. The front wall or edge 236 is sloped to preferably approximately 45 degrees from the post, which is a sufficient amount to allow the post to be pushed through the earring back without having to compress the front and intermediate legs. The sloped front wall 236 acts as a cam surface to help the edges of the apertures that contact the sloped front wall slide up and over the post sections between the grooves. This allows the earring back to simply be pushed onto the post without compressing the front and intermediate legs.

The rear wall or edge 238 is preferably less sloped, and at a substantially right angle to the bottom 240. This steep angle between the bottom 240 and the rear wall 238 inhibits the removal of the earring back from the post without compressing the front and intermediate legs together to align the apertures. The circumferential edges of the apertures engage that steep back wall 238, which does not act as a ramp or cam surface like the front wall 236, and the earring back thus is difficult to properly remove without compressing the front and intermediate legs.

While the invention has been particularly shown and described with reference to a preferred embodiment thereof, it will be understood by those skilled in the art that various other changes in the form and details may be made without departing from the spirit and scope of the invention.

We claim:

1. An earring back for receiving a post of an earring, comprising:

a base including a base aperture therein for receiving said post;

a first primary leg extending from a first end of said base;

a second primary leg extending from a second end of said base;

a first spring leg extending from said first primary leg and being coextensive with the length of said first primary leg, said first spring leg including a front face, said front face including a front tear-drop shaped aperture therein for receiving said post; and a second spring leg extending from said second primary leg and being coextensive with the length of said second primary leg, said second spring leg including an intermediate face, said intermediate face including an intermediate aperture therein for receiving said post, wherein when no external forces are applied to the earring back, the front aperture, the intermediate aperture, and the base aperture are in axial misalignment;

wherein said base, said first primary leg, and said second primary leg form a U-shaped member extending away from said front face.

2. The earring back of claim 1, wherein said first spring leg is L-shaped extending inwardly far enough to extend laterally over substantially all of the base.

3. The earring back of claim 1, wherein said second spring leg is L-shaped extending inwardly far enough to extend laterally over substantially all of the base.

4. The earring back of claim 1, wherein said first spring leg has at least one surface curve along a portion of the first spring leg.

5. The earring back of claim 1, wherein said second spring leg has at least one surface curve along a portion of the second spring leg.

6. The earring back of claim 1, wherein said base aperture is substantially circular.

7. The earring back of claim 1, wherein said front face has an indentation about the front aperture to assist the insertion of the post into said front aperture.

8. The earring back of claim 1, wherein said intermediate face is positioned between said base and said front face.

9. A system for securing jewelry to a person's body, the system comprising:

a piece of jewelry;

a post attached to said piece of jewelry, said post having a surface treatment; and a clamping device adapted to receive said post, said clamping device comprising:

a base including a base aperture therein for receiving said post;

a first primary leg extending from a first end of said base;

a second primary leg extending from a second end of said base;

a first spring leg extending from said first primary leg and being coextensive with the length of said first primary leg, said first spring leg including a front face, said front face including a front aperture therein for receiving said post; and a second spring leg extending from said second primary leg and being coextensive with the length of said second primary leg, said second spring leg including an intermediate face, said intermediate face including an intermediate aperture therein for receiving said post, wherein when no external forces are applied to the clamping device, the front aperture, the intermediate aperture, and the base aperture are in axial misalignment;

wherein said base, said first primary leg, and said second primary leg form a U-shaped member extending away from said front face.

10. The system of claim 9, wherein said post has at least one circumferential notch adapted to couple with said front aperture of said clamping device.

11. The system of claim 10, wherein said circumferential notch is angled along the axis of the post.

12. The system of claim 10, wherein said circumferential notch has a front edge and a rear edge, and said front edge is angled along the axis of the post.

13. The system of claim 12, wherein said angle is approximately 45 degrees from the post.

14. The system of claim 10, wherein said circumferential notch has a front edge and a rear edge, and said rear edge is angled along the axis of the post.

15. The system of claim 10, wherein said circumferential notch has a front edge and a rear edge, and said front edge and said rear edge are angled along the axis of the post.

16. The system of claim 9, wherein said front face has an indentation about the front aperture to assist the insertion of the post into said front aperture.

17. The system of claim 9, wherein said intermediate aperture is tear drop shaped.

18. The system of claim 9, wherein said intermediate face is positioned between said base and said front face.

* * * * *